US008959865B2

(12) United States Patent
Kratz et al.

(10) Patent No.: US 8,959,865 B2
(45) Date of Patent: Feb. 24, 2015

(54) METHOD FOR ERECTING A BUILDING STRUCTURE WITH CONSTRUCTION ELEMENTS AND A SYSTEM OF CONSTRUCTION ELEMENTS THEREFOR

(76) Inventors: Marlon Roger Philip Kratz, Nieuwegein (NL); Ricardus Josephus Johannus Maria van Oostrum, Utrecht (NL)

( * ) Notice: Subject to any disclaimer, the term of this patent is extended or adjusted under 35 U.S.C. 154(b) by 0 days.

(21) Appl. No.: 13/704,457

(22) PCT Filed: Jun. 15, 2011

(86) PCT No.: PCT/NL2011/050434

§ 371 (c)(1),
(2), (4) Date: Feb. 22, 2013

(87) PCT Pub. No.: WO2011/159158

PCT Pub. Date: Dec. 22, 2011

(65) Prior Publication Data

US 2013/0167466 A1 Jul. 4, 2013

(30) Foreign Application Priority Data

Jun. 16, 2010 (NL) ..... 2004901

(51) Int. Cl.
*E04B 1/02* (2006.01)
*E04B 5/04* (2006.01)
(Continued)

(52) U.S. Cl.
CPC ... *E04C 1/40* (2013.01); *E04B 2/02* (2013.01); *E04G 21/14* (2013.01)
USPC ..... 52/561; 52/562; 52/596; 405/16; 405/284; 405/302.4

(58) Field of Classification Search
CPC ..... B28B 7/065; E02B 3/127; E02B 3/108; E04B 2/08; E04B 2/8664; E04B 2/02; E04C 1/40; E04C 1/41; E04G 21/14; Y10S 229/919
USPC ..... 52/561, 562, 596, 592.1, 592.2, 592.3; 405/16, 284, 302.4
See application file for complete search history.

(56) References Cited

U.S. PATENT DOCUMENTS 3,665,669 A * 5/1972 Huber ..... 52/592.3
3,702,520 A * 11/1972 Huber et al. ..... 52/284
(Continued)

FOREIGN PATENT DOCUMENTS

BE 560165 9/1957
CA 2320009 12/2000
(Continued)

OTHER PUBLICATIONS

PCT Application No. PCT/NL2011/050434, International Search Report and Written Opinion of the International Searching Authority published Dec. 11, 2011.
(Continued)

*Primary Examiner* — Phi A
*Assistant Examiner* — Omar Hijaz
(74) *Attorney, Agent, or Firm* — McDonnell Boehnen Hulbert & Berghoff

(57) ABSTRACT

The present invention relates to a method for erecting a building structure with construction elements, wherein the construction elements comprise block-shaped bags filled with filling material and having an upper side, a lower side, a front side, a rear side, a right end surface and a left end surface, and wherein the block-shaped, bag-like construction elements of a first type are basic wall elements provided with connecting flaps at least close to the two end surfaces; the method comprising at least the steps of: —arranging at least two basic wall elements adjacently of each other on a ground surface, wherein the right end surface of the first basic wall element and the left end surface of the second basic wall element are placed close to each other; —placing against each other the connecting flaps of respectively the first and second basic wall elements situated close to the end surfaces placed closely together; and—mutually connecting the connecting flaps. The invention further relates to a system of construction elements for applying such a method.

18 Claims, 14 Drawing Sheets

(51) Int. Cl.

| | |
|---|---|
| ***E02B 3/12*** | (2006.01) |
| ***E02D 3/02*** | (2006.01) |
| ***E02D 3/00*** | (2006.01) |
| ***E04C 1/40*** | (2006.01) |
| ***E04B 2/02*** | (2006.01) |
| ***E04G 21/14*** | (2006.01) |

(56) References Cited

U.S. PATENT DOCUMENTS

| | | | | |
|---|---|---|---|---|
| 3,886,751 | A | 6/1975 | Porraz Jimenez Labora | |
| 4,499,599 | A * | 2/1985 | Polett et al. | 383/6 |
| 4,608,799 | A * | 9/1986 | Hasegawa | 52/578 |
| 4,650,368 | A * | 3/1987 | Bayer | 405/111 |
| 5,584,599 | A * | 12/1996 | Knittel | 405/15 |
| 5,662,508 | A * | 9/1997 | Smith | 446/128 |
| 5,934,027 | A * | 8/1999 | Khalili | 52/167.1 |
| 5,971,661 | A * | 10/1999 | Johnson et al. | 405/114 |
| 6,612,741 | B1 * | 9/2003 | Horne | 383/43 |
| 7,314,336 | B2 * | 1/2008 | Moss | 405/262 |
| 7,329,069 | B2 * | 2/2008 | Slater et al. | 405/114 |
| 8,382,400 | B2 * | 2/2013 | Powell | 405/284 |
| 2007/0140598 | A1 * | 6/2007 | McGillick et al. | 383/22 |

FOREIGN PATENT DOCUMENTS

| | | |
|---|---|---|
| CN | 200949275 | 9/2007 |
| CN | 101575879 | 11/2009 |
| GB | 2061348 | 5/1981 |

OTHER PUBLICATIONS

PCT Application No. PCT/NL2011/050434, International Preliminary Report on Patentability and Written Opinion of the International Searching Authority mailed Jan. 3, 2013.

* cited by examiner

METHOD FOR ERECTING A BUILDING STRUCTURE WITH CONSTRUCTION ELEMENTS AND A SYSTEM OF CONSTRUCTION ELEMENTS THEREFOR

CROSS-REFERENCE TO RELATED APPLICATIONS

This national stage patent application under 35 U.S.C. §371 claims priority to PCT application no. PCT/NL2011/050434 filed Jun. 15, 2011, which claims priority to Netherlands patent application no. 2004901 filed Jun. 16, 2010, the disclosures of each of which are incorporated herein by reference for all purposes.

The present invention relates to a method for erecting a building structure with construction elements, and to a system of construction elements therefor.

The erection of a building using filled bags is a per se known method applied particularly in less developed regions. Bags applied for these construction methods are also known as earthbags.

A drawback of such conventional earthbags is the great variability in the maximum compression force at which they collapse. Because no compression force to be supported has been laid down, these conventional earthbags do not comply with EU building standards and as such are not permitted as construction method within Europe.

There is a need for construction methods in which durable construction techniques are applied, and which are in particular easy to apply.

An object of the present invention is to provide a method and a system of associated construction elements, wherein the stated drawbacks do not occur, or do so to lesser extent, and which in particular provide an increased structural stiffness within a building structure erected from such construction elements.

Said object is achieved with the method for erecting a building structure with construction elements, wherein the construction elements comprise block-shaped bags filled with filling material and having an upper side, a lower side, a front side, a rear side, a right end surface and a left end surface; and wherein the block-shaped, bag-like construction elements of a first type are basic wall elements provided with connecting flaps at least close to the two end surfaces;

the method comprising at least the steps of:

arranging at least two basic wall elements adjacently of each other on a ground surface, wherein the right end surface of the first basic wall element and the left end surface of the second basic wall element are placed close to each other;

placing against each other the connecting flaps of respectively the first and second basic wall elements situated close to the end surfaces placed closely together; and mutually connecting the connecting flaps.

The construction elements are connected to each other by means of mutually connecting the connecting flaps. A layer is thus built up using construction elements placed adjacently of each other. A wall of a building structure can thus be erected using multiple layers arranged one above another.

Where conventional earthbags generally acquire their structural stiffness through hardening of the filling material, the construction elements according to the invention with their connecting flaps are constructed such that the structural stiffness is provided particularly by the construction element. This is even the case when they are filled with granular, non-hardening filling material, such as sand. Conventional earthbags are filled for instance with clay which after hardening forms a so-called adobe block, wherein the hardened clay is responsible for the provided compression strength.

The method according to the invention is environmentally-friendly, particularly because much less energy and material is required for the production of the construction elements as applied according to the present invention than for conventional construction methods, such as building with solid building bricks, steel and concrete.

According to a preferred embodiment, the connecting flaps are connected to each other by being sewn together. A sewn connection is simple to arrange and provides a highly robust connection.

According to a further preferred embodiment, the connecting flaps are connected to each other by means of glueing, this likewise being a connecting method which is very easy to apply.

According to yet another preferred embodiment, the block-shaped, bag-like basic wall elements are further provided with a further connecting flap, wherein the connecting flap is arranged on the upper surface and substantially midway between the two end surfaces, and wherein the connecting flap extends from the upper surface at least over a distance greater than the height h of a basic wall element, and the method further comprises at least the steps of:

placing a further basic wall element in half-brick bond on top of two adjacently placed basic wall elements which are fixed to each other; and at least connecting the connecting flaps of construction elements of different height layers of the building structure so that a connection is provided between construction elements of different height layers.

Because construction elements of different height layers are mutually connected, a building structure erected from multiple height layers of construction elements is very sturdy.

According to yet another preferred embodiment, the step of connecting the connecting flaps of construction elements in different height layers of the building structure comprises the following sub-steps of:

folding the mutually connected connecting flaps substantially flat onto the upper surface of one of the two adjacently placed basic wall elements which are fixed to each other;

wherein the connecting flaps of the two adjacently placed basic wall elements which are fixed to each other extend respectively along the left end surface and right end surface of the basic wall element placed on top thereof in half-brick bond;

placing against each other the connecting flap, arranged close to the left end surface, of the basic wall element placed on top and the connecting flap of the basic wall element situated thereunder;

placing against each other the connecting flap, arranged close to the right end surface, of the basic wall element placed on top and the connecting flap of the basic wall element situated thereunder; and wherein the connecting flaps placed against each other are mutually connected.

According to yet another preferred embodiment, at least one block-shaped, bag-like construction element of a second type is provided which are filling wall elements which have substantially the same width b and height h as the basic wall elements, but the length $l_{E2}$ of which is substantially half the length $l_{E1}$ of a basic wall element;

wherein a connecting flap is arranged close to an end surface of the filling wall element;

the method further comprising the steps of:

placing a filling wall element on an end face of a wall of the building structure to be constructed such that the half-brick bond of basic wall elements is filled and a flat side is obtained on the end face.

By combining basic wall elements and filling wall elements the basic wall elements can be placed in the structurally strong half-brick bond while the filling wall elements provide the possibility of being able to make flat end faces of the walls.

According to yet another preferred embodiment, the method further comprises the steps of:

placing close to each other the connecting flap of the basic wall element and the connecting flap of the filling wall element; and mutually connecting the connecting flaps of the basic wall element and the filling wall element for the purpose of mutually connecting the two wall elements.

According to yet another preferred embodiment, the method further comprises the step of:

placing the connecting flap of a construction element of a lower layer between the connecting flap of the basic wall element and the connecting flap of the filling wall element;

mutually connecting the connecting flaps of the basic wall element, the filling wall element and the connecting flap of the construction element of the lower-lying layer for the purpose of mutually connecting these three construction elements, and a connection is provided between construction elements in different height layers.

Because construction elements, in particular basic wall elements and filling wall elements, of different height layers are connected to each other, a building structure constructed from multiple height layers is very sturdy.

In order to enable arranging of a corner in a building structure, there are further provided according to a first aspect of the invention and according to yet another preferred embodiment:

at least one block-shaped, bag-like construction element of a third type which is a first corner element;

at least one block-shaped, bag-like construction element of a fourth type which is a second corner element;

at least one block-shaped, bag-like construction element of a fifth type which is a third corner element;

the method further comprising at least the steps of:

alternately arranging a first corner element and a third corner element in successive layers in the corner to be formed; and arranging a second corner element in a layer in which a first corner element has been arranged in the corner to be formed so that the first and second corner elements together provide a half-brick bond with the adjacent layer in which the third corner element is arranged in the corner.

The first, second and third corner elements together guarantee that a half-brick bond can be maintained, with the advantage that, with application of these three corner elements, any length-width ratio of the construction elements can be applied. This gives the construction designer the freedom to apply the structurally strongest ratio.

In order to enable the arranging of a corner in a building structure, there are further provided according to a second aspect of the invention and according to yet another preferred embodiment:

at least one block-shaped, bag-like construction element of an eighth type which is a fourth corner element; and at least one block-shaped, bag-like construction element of a ninth type which is a fifth corner element;

wherein the fourth corner elements and fifth corner elements comprise a length-width ratio of l:b=2:1 and have the same width b, height h and length l as the basic wall elements;

wherein a connecting flap is arranged close to an end surface; and wherein a connecting flap is arranged at least close to a part of a side of a front or rear surface;

the method further comprising at least the step of:

alternately arranging a fourth corner element and a fifth corner element in successive layers in the corner to be formed.

According to the second aspect of the invention for arranging a corner in a building structure, the block-shaped, bag-like construction elements of the eight type (the fourth corner elements) and the ninth type (the fifth corner elements) have the particular feature that they comprise a length-width ratio of l:b=2:1 and further have the same width, height and length as the basic wall elements. Only two different corner elements, respectively the fourth and fifth corner elements, hereby suffice. These fourth and fifth corner elements moreover have the advantage of having the same width, height and length as the basic wall elements, this further simplifying the system of multiple construction elements in production engineering terms.

According to yet another preferred embodiment, a connecting flap is arranged on the upper surface of the fourth and fifth corner elements which extends from the upper surface at least over a distance greater than the height h of a basic wall element;

the method further comprising at least the step of:

mutually connecting successive layers by connecting a connecting flap of a corner element of a lower-lying layer to at least a connecting flap of a construction element of a higher-lying layer.

Because the construction elements, in particular the corner elements, of different height layers are mutually connected, a building structure constructed from multiple height layers is very sturdy.

According to yet another preferred embodiment, the method is preceded by the step of filling the construction elements with a filling material.

This filling material is preferably introduced into the construction elements only at or close to the construction site, this having the logistic advantage than the still empty construction elements can be transported while very light and in volume-saving manner.

The filling material is preferably already fine material which is not susceptible to rot and moreover retains its volume, such as plastic granulate and construction waste supplemented with sand. It is also possible to envisage the filling material being (extruder) clay which, after hardening thereof, provides very sturdy blocks moreover having a high degree of fire safety.

When natural material such as sand or earth is applied as filling material, the filling can be reused or returned to nature without a recycling process after the dwelling has been demolished. The invention thus provides a very environmentally-friendly building concept.

The invention further relates to a system of construction elements for application in the method as described in the foregoing, the construction elements comprising:

a bag which comprises an upper side, a lower side, a front side, a rear side, a right end surface and a left end surface and which is fillable to substantially a block shape using filling material; and wherein the block-shaped, bag-like construction element is provided on the outer side thereof with one or more connecting flaps so that the construction elements can be coupled to each other by means of mutually connecting the connecting flaps.

According to a preferred embodiment, the construction elements are manufactured from textile, preferably geotextile.

According to a further preferred embodiment, the construction elements are reinforced with carbon fibre. This carbon fibre is preferably interwoven with the geotextile.

According to yet another preferred embodiment, the construction elements are provided with an internally arranged, arcuate reinforcement.

This arcuate reinforcement transmits compression forces exerted on the construction element to the edges of the block-shaped construction elements. The lower surface of the construction element is placed under strain of tension via these edges. This transmission of compression forces by the arcuate reinforcement enables the construction element to withstand higher compression forces.

The arcuate reinforcement is preferably of a somewhat resilient material such as carbon fibre, glass fibre or a somewhat resilient composite.

Although the arcuate reinforcement can be arranged in transverse direction and in lengthwise direction in the construction element, arrangement thereof in lengthwise direction provides a further structural advantage. The compression forces transmitted to the edges are now also absorbed by an edge of an adjacent construction element, the arcuate reinforcement of which will further absorb and transmit part of the force.

According to yet another preferred embodiment, at least the front and/or rear surface of the construction element is provided with a fire-resistant material.

According to yet another preferred embodiment, at least the upper and/or lower surface of the construction element is provided with one or more reinforcing strips oriented in the width direction of the construction element.

In a preferred embodiment the reinforcing strips are manufactured from carbon fibre.

A fire-resistant front and rear surface are ideally combined with reinforcing strips arranged in upper and lower surface, so that in the case of fire the integrity of the building structure erected from construction elements is retained. Material with a relatively low melting temperature, such as polypropylene (PP), can hereby be applied as filler.

According to yet another preferred embodiment, the block-shaped, bag-like construction elements of a first type are basic wall elements which have a length $l_{E1}$, width b and height h and which are provided with connecting flaps at least close to both end surfaces. The construction elements can be mutually coupled using the connecting flaps.

According to yet another preferred embodiment, a further connecting flap is provided which extends from the upper surface at least over a distance greater than the height h of a basic wall element.

Using this further connecting flap construction elements from different height layers can be mutually connected, whereby a building structure erected from multiple height layers of construction elements becomes very sturdy.

According to yet another preferred embodiment, the connecting flap is arranged on the upper surface and substantially midway between the two end surfaces. By arranging this further connecting flap substantially midway between the two end surfaces the construction elements become suitable for use in a half-brick bond, this enabling a structurally strong construction of a wall.

According to yet another preferred embodiment, the block-shaped, bag-like construction elements of a second type are filling wall elements, comprising the same width b and height h as the basic wall elements, but the length $l_{E2}$ of which is substantially half the length $l_{E1}$ of the basic wall elements;

wherein a connecting flap is arranged close to one end surface of the filling wall element.

Because the filling wall elements have a length $l_{E2}$ which is substantially half the length $l_{E1}$ of a basic wall element, the filling wall elements and basic wall elements can be combined such that they can be placed in the structurally strong half-brick bond, while the filling wall elements provide the possibility of being able to make flat end faces of the walls.

In order to enable arranging of a corner in a building structure, according to a first aspect of the invention the block-shaped, bag-like construction elements of a third type are first corner elements;

comprising the same width b and height h as the basic wall elements, but the length $l_{E3}$ of which is substantially equal to the sum of the width b and half the length $l_{E1}$ of the basic wall element;

wherein a connecting flap is arranged close to an end surface of the first corner element; and wherein a connecting flap is arranged at least close to a part of a side of a front or rear surface of the first corner element.

According to yet another preferred embodiment, the first corner element is provided with a further connecting flap;

wherein the connecting flap is arranged on the upper surface between the two end surfaces, wherein the distance from a first end surface substantially corresponds to the width b of a basic wall element, and the distance from the other end surface substantially corresponds to half the length of a basic wall element; and wherein the connecting flap extends from the upper surface at least over a distance greater than the height h of a basic wall element. The first corner element can hereby be coupled to construction elements in other height layers of the building structure.

According to yet another preferred embodiment, the block-shaped, bag-like construction elements of a fourth type are second corner elements;

comprising the same width b and height h as the basic wall elements, but the length $l_{E4}$ of which is substantially equal to one and a half times the length $l_{E1}$ of a basic wall element minus the width b of a basic wall element;

wherein connecting flaps are provided at least close to both end surfaces.

When a second corner element with a length $l_{E4}=1.5*l_{E1}-b$ is placed in a corner against a third corner element of width b, these second and third corner elements together extend a length $1.5*l_{E1}-b+b=1.5*l_{E1}$ from the corner, whereby a half-brick bond remains ensured.

According to yet another preferred embodiment, the second corner element is provided with a further connecting flap;

wherein the connecting flap is arranged on the upper surface between the two end surfaces, wherein the distance from a first end surface substantially corresponds to half the length $l_{E1}$ of a basic wall element, and the distance from the other end surface substantially corresponds to a length $l_{E1}$ of a basic wall element minus the width b of a basic wall element; and wherein the connecting flap extends from the upper surface at least over a distance greater than the height h. The second corner element can hereby be coupled to construction elements in other height layers of the building structure.

According to yet another preferred embodiment, the block-shaped, bag-like construction elements of a fifth type are third corner elements;

comprising the same width b, height h as the basic wall elements, and wherein the length $l_{E5}$ is also substantially equal to the length $l_{E1}$ of a basic wall element;

wherein a connecting flap is arranged close to an end surface of the third corner element; and wherein a connecting flap is arranged at least close to a part of a side of a front or rear surface of the third corner element.

According to yet another preferred embodiment, the third corner element is provided with a further connecting flap;

wherein the connecting flap is arranged on the upper surface between the two end surfaces, wherein the distance from a first end surface substantially corresponds to a width b of a basic wall element, and the distance from the other end surface substantially corresponds to a length $l_{E1}$ of a basic wall element minus a width b of a basic wall element; and wherein the connecting flap extends from the upper surface at least over a distance greater than the height h. The third corner element can hereby be coupled to construction elements in other height layers of the building structure.

According to yet another preferred embodiment, the block-shaped, bag-like construction elements of a sixth type are basic adjusting frame elements;

comprising the same dimensions as a basic wall element;

wherein a connecting flap is provided close to only one end surface; and wherein a channel-like recess is arranged in the other end surface in the height direction of the basic adjusting frame element, which recess is suitable for receiving an adjusting frame therein.

According to yet another preferred embodiment, the block-shaped, bag-like construction elements of a seventh type are filler adjusting frame elements;

comprising the same dimensions and structure as a filling wall element; and wherein a channel-like recess is arranged in the height direction of the filler adjusting frame element in the end surface opposite the end surface provided with the connecting flap ($C^1$), which recess is suitable for receiving an adjusting frame therein.

In order to enable arrangement of a corner in a building structure, according to a second aspect of the invention the block-shaped, bag-like construction elements of an eighth and ninth type are respectively fourth and fifth corner elements. According to this second aspect, the basic wall element and/or the basic adjusting frame element and/or the fourth corner element and/or the fifth corner element comprise a length-width ratio of l:b=2:1. These construction elements with a length-width ratio of 2:1 provide the particular advantage that only two different corner elements are necessary to arrange a corner in a building structure. These two different corner elements are further described hereinbelow.

According to yet another preferred embodiment, the block-shaped, bag-like construction elements are corner elements;

comprising the same width b, height h and length l as a basic wall element;

wherein a connecting flap is arranged close to an end surface of the corner element; and wherein a connecting flap is arranged at least close to a part of a side of a front or rear surface of the corner element.

The specific location of the connecting flaps differs so that the respective block-shaped, bag-like construction elements of an eighth type (fourth corner elements) and ninth type (fifth corner elements) described below are obtained with which a corner can be constructed.

These eighth and ninth corner elements correspond to the basic wall elements in terms of dimensions, this providing a simplification of the system of construction elements.

According to yet another preferred embodiment of the corner element, a connecting flap is further arranged on the upper surface and substantially midway between the two end surfaces; and wherein the connecting flap extends from the upper surface at least over a distance greater than the height h of a basic wall element. The fourth corner element can hereby be coupled to construction elements in other height layers of the building structure.

The connecting flap is in principle situated on the upper surface between the two end surfaces, wherein the distance from a first end surface substantially corresponds to a width b of a basic wall element, and the distance from the other end surface substantially corresponds to a length $l_{E1}$ of the basic wall element minus the width b of a basic wall element. At the specific length-width ratio of 2:1 this is simplified to a connecting flap arranged on the upper surface substantially midway between the two end surfaces.

Preferred embodiments of the present invention are further elucidated in the following description with reference to the drawing, in which.

Figure 1:
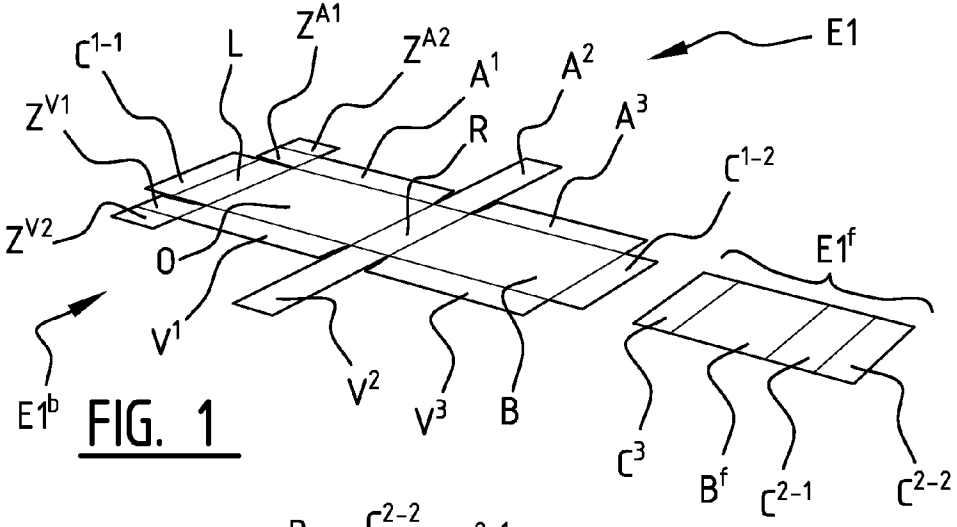
FIG. 1 is a perspective view of an unfolded piece of geotextile for forming of a construction element therefrom.

The perspective view of FIG. 1 shows an unfolded piece of geotextile for forming of a construction element therefrom. Although FIG. 1 shows a basic wall element E1, the elucidation given with reference to FIGS. 1-7 is likewise applicable to the other construction elements E1-E9 incorporated in this patent application.

The construction elements E1-E9 are made up of a lower surface O, an upper surface B, a front side surface V, a rear side surface A, a right end surface R, a left end surface L and one or more connecting surfaces $C^1$, $C^2$, $C^3$, which will be referred to hereinbelow as connecting flaps. The front side surface V is assembled from a first part $V^1$, a second part $V^2$ and a third part $V^3$ which, in the assembled state of construction element E1-E9, come to lie over each other and thus form a sturdy front side surface V. The rear side surface A is assembled in similar manner from a first part $A^1$, a second part $A^2$ and a third part $A^3$.

The first connecting surface $C^1$ is assembled from a first part $C^{1-1}$ and a second part $C^{1-2}$ which in the unfolded state (FIG. 1) are situated on both outer ends of the basic part E1$^b$ of basic wall element E. In the folded state these connecting flaps $C^{1-1}$ and $C^{1-2}$ come to lie against each other. After filling of a folded construction element these connecting flaps $C^{1-1}$ and $C^{1-2}$ will be connected to each other, for instance by being sewn together.

Figure 2:
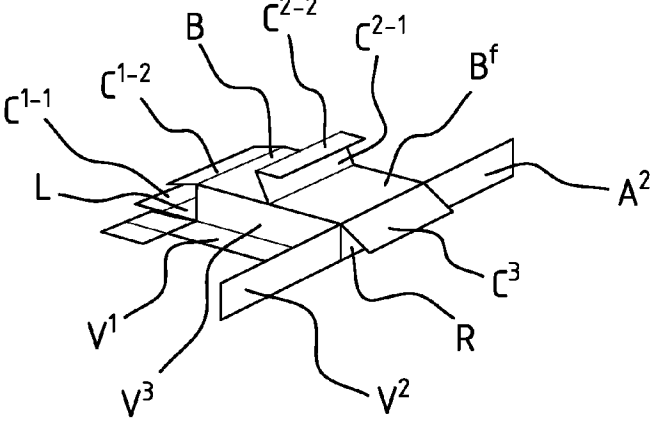
FIG. 2 is a perspective view of a construction element formed from the piece of geotextile shown in FIG. 1.

As can be seen in the view of the folded construction element E1 in FIG. 2, it also comprises, in addition to the first connecting flap $C^1$, (here still consisting of the individual connecting flaps $C^{1-1}$ and $C^{1-2}$), a second connecting flap $C^2$ and a third connecting flap $C^3$.

In order to provide a basic wall element E1 which also comprises a second connecting flap $C^2$ and a third connecting flap $C^3$ in addition to the first connecting flap $C^1$, a flap apart E1$^V$ is arranged on the basic part E1$^b$ of the basic wall element E1, for instance by means of sewing these two geotextile parts to each other.

Figure 3:
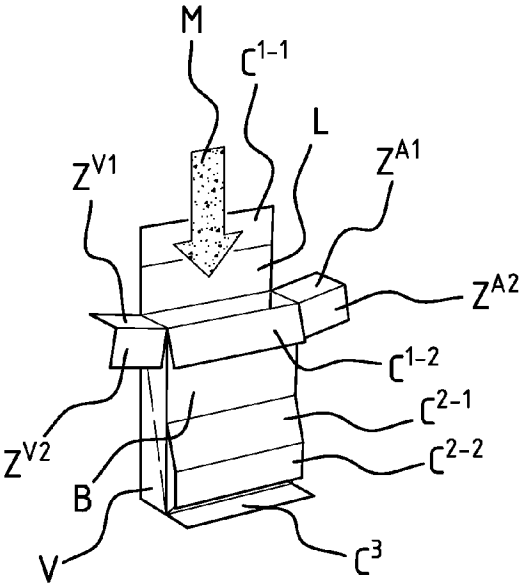
FIG. 3 is a perspective view of the step of filling the construction element shown in FIG. 2 with a filling material.

FIG. 3 shows the step in which the basic wall element E1 assembled in FIG. 2 is filled with a filling material M, which preferably comprises a fine grain material which is not susceptible to rot and which moreover substantially retains volume. Suitable materials are for instance plastic granulate, construction waste, sand or the like.

Figure 5:
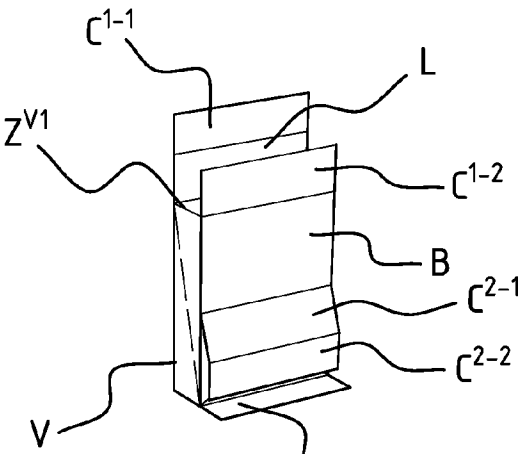
FIG. 5 is a perspective view of a second sub-step of folding closed the construction element shown in FIGS. 3 and 4.
Figure 4:
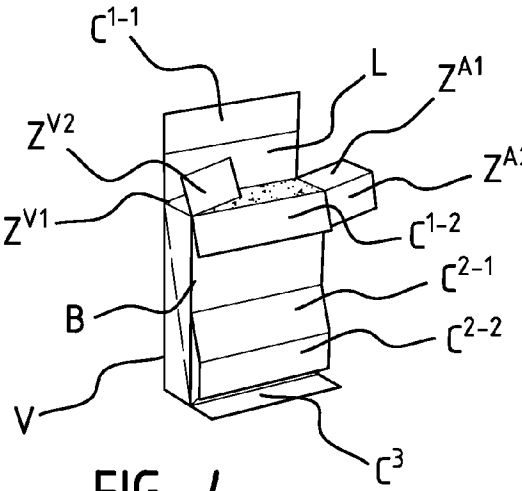
FIG. 4 is a perspective view of a first sub-step of folding closed the construction element shown in FIG. 3.
Figure 6:
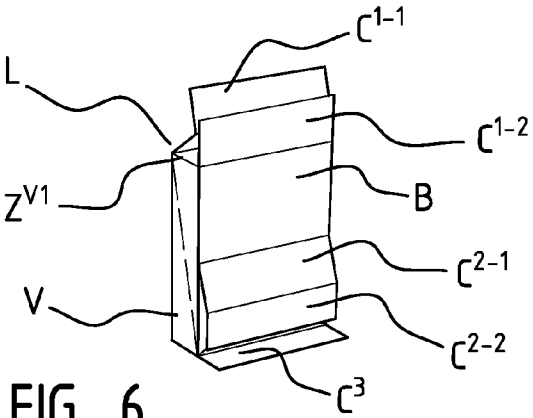
FIG. 6 is a perspective view of a third sub-step of folding closed the construction element shown in FIGS. 3-5.

Once the basic wall element E1 has been filled, the geotextile bag is folded closed as according to the steps shown in FIGS. 4, 5 and 6. The first side part $Z^{V1}$ of the front side surface V and the first side part $Z^{A1}$ of the rear side surface A are first folded inward. The second side part $Z^{V2}$ of the front side surface V and the second side part $Z^{A2}$ of the rear side surface A are then placed between the second part $C^{1-2}$ of the first connecting flap $C^1$ and the first part $C^{1-1}$ of the first connecting flap $C^1$ by folding the left end surface L inward (FIG. 6). The first connecting flap $C^1$ is then formed by sewing together the first part $C^{1-1}$ and the second part $C^{1-2}$, between which are situated the second side part $Z^{V2}$ of the front side surface V and the second side part $Z^{A2}$ of the rear side surface A.

Figure 7A:
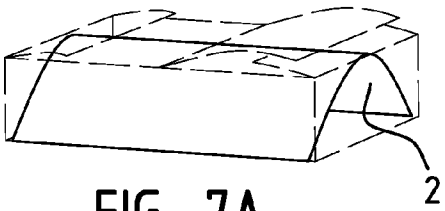
FIG. 7A is a cut-away perspective view of the construction element of FIG. 7 provided with an arcuate reinforcement arranged in transverse direction.
Figure 7B:
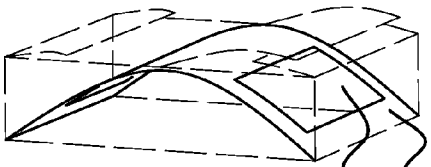
FIG. 7B is a cut-away perspective view of the construction element of FIG. 7 provided with an arcuate reinforcement arranged in lengthwise direction.
Figure 7C:
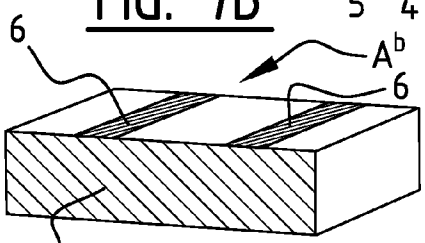
FIG. 7C is a cut-away perspective view of the construction element of FIG. 7 provided with a fire-resistant front and rear surface and reinforcing strips arranged in width direction.
Figure 7:
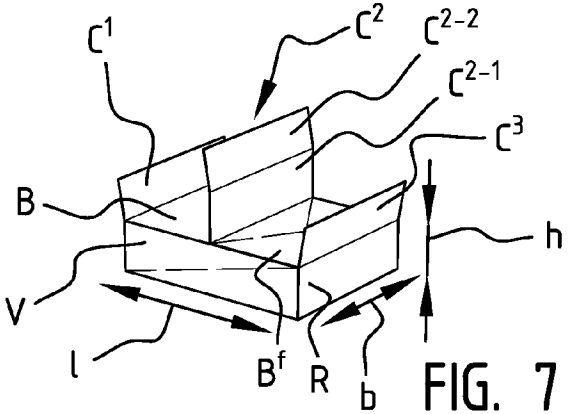
FIG. 7 is a perspective view of a construction element folded fully closed.

FIG. 7 shows a basic wall element E1 which is folded fully closed and has a length l, width b, and a height h.

In a preferred embodiment the construction element is provided with an arcuate reinforcement 2, 4 which transmits compression forces exerted on the construction element to the edges of the construction element. In the embodiment shown in FIG. 7A the arcuate reinforcement 2 is arranged in transverse direction of the construction element, while in the embodiment shown in FIG. 7B the arcuate reinforcement 4 is arranged in lengthwise direction. The arcuate reinforcement 4 shown in FIG. 7B and arranged in lengthwise direction of the construction element is provided with an opening 5 so that filling of the construction element with filling material is made possible.

FIG. 7C shows a construction element provided with a fire-resistant front surface $V^B$ and fire-resistant rear surface $A^B$, and wherein reinforcing strips 6 are arranged in width direction on the upper surface B and lower surface O.

If desired, the end surfaces are also provided with a fire-resistant surface so that the construction elements according to the invention become highly fire-resistant and as such can be applied for temporary erection of a fire-resistant building structure. The invention thus provides the option of erecting a temporary barrier between a source of fire and an area to be protected.

When the arcuate reinforcement 2 shown in FIG. 7A is applied, it is particularly advantageous to arrange reinforcing strips 6 at least in the lower surface O of the construction element so that transmission of a compression force will result in a tensile strain in lower surface O and can be absorbed by these reinforcing strips 6.

Figure 8A:
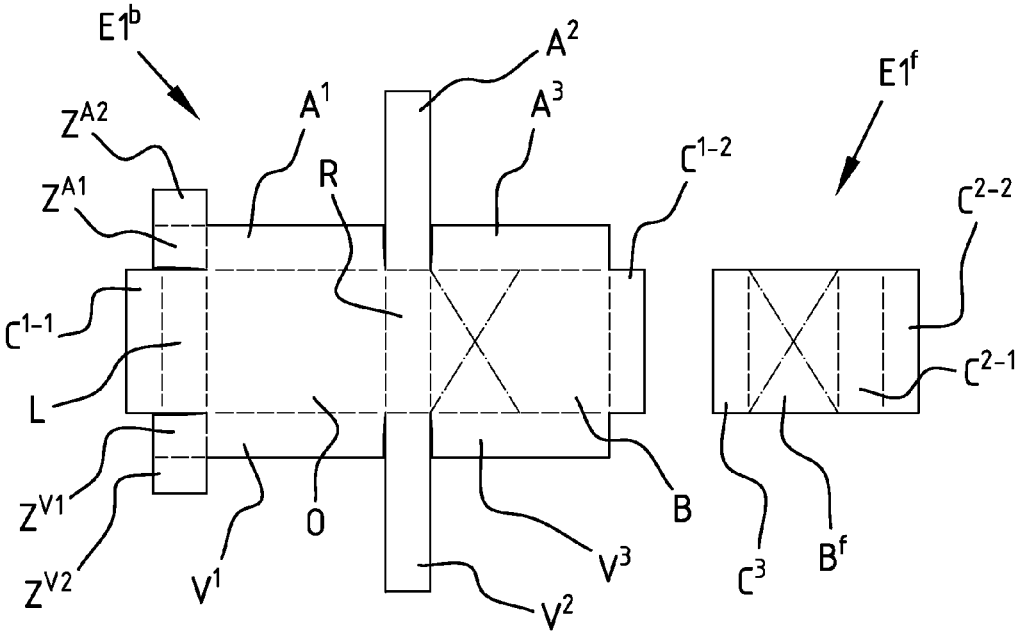
FIGS. 8A, 8B show a view of an unfolded basic wall element (A) with dimensions of the surfaces (B)
Figure 8B:
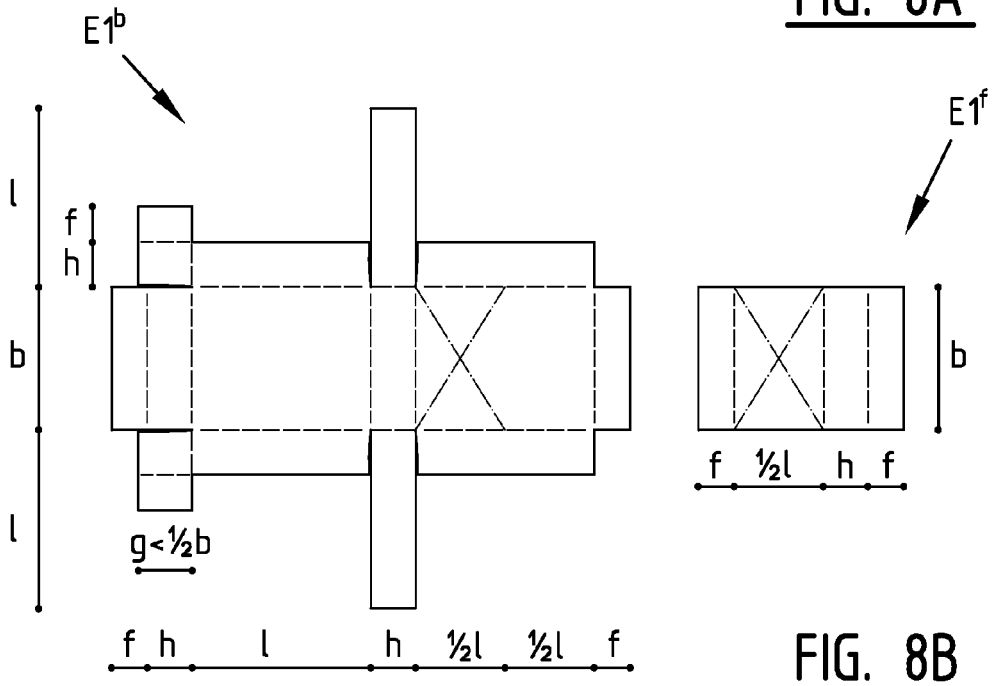
Figure 9A:
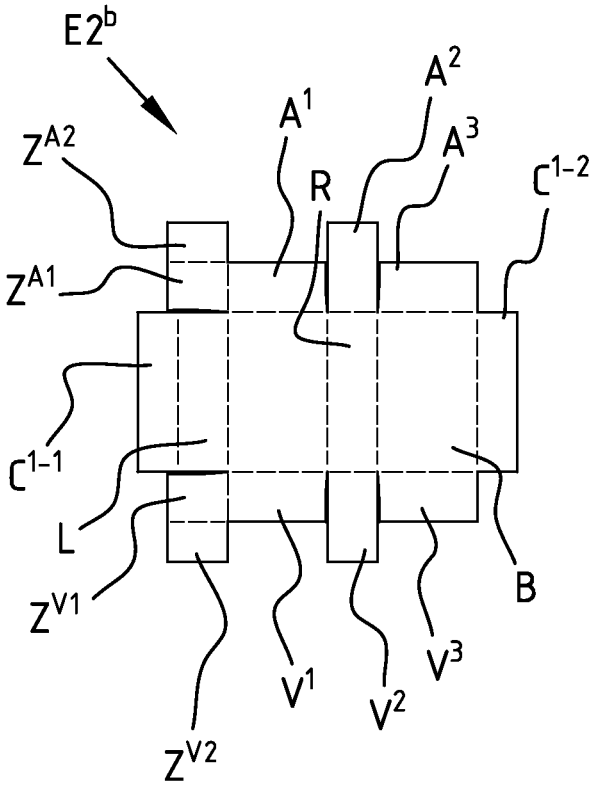
FIGS. 9A, 9B show a view of an unfolded filling wall element (A) with dimensions of the surfaces (B)
Figure 9B:
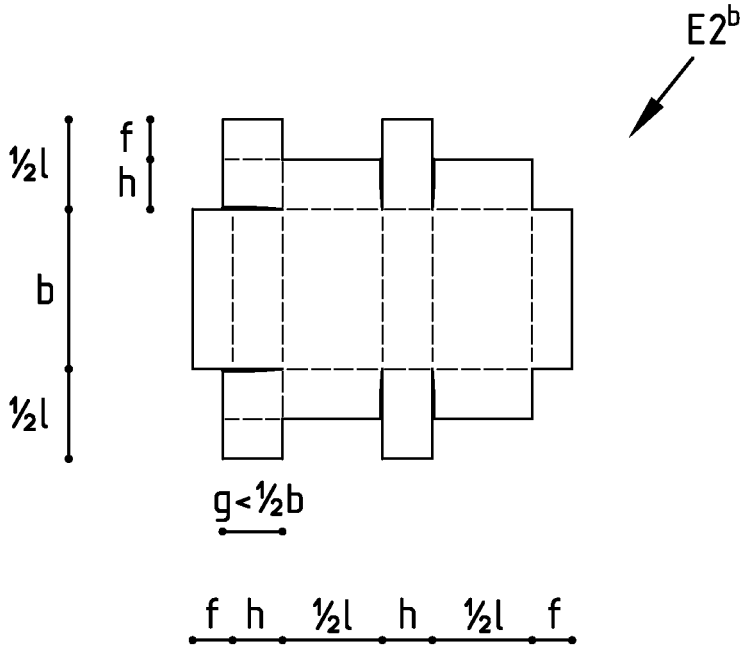
Figure 10A:
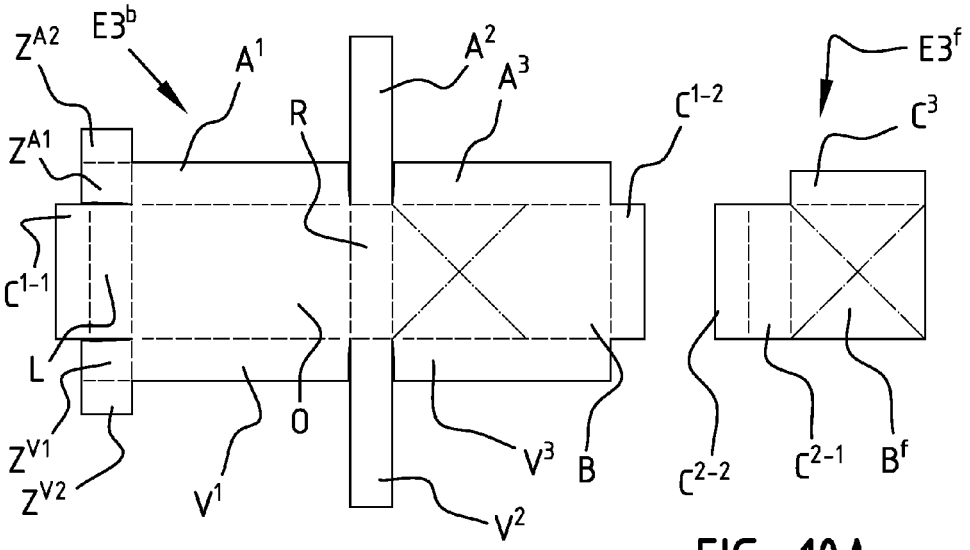
FIGS. 10A, 10B show a view of an unfolded first corner element (A) with dimensions of the surfaces (B)
Figure 10B:
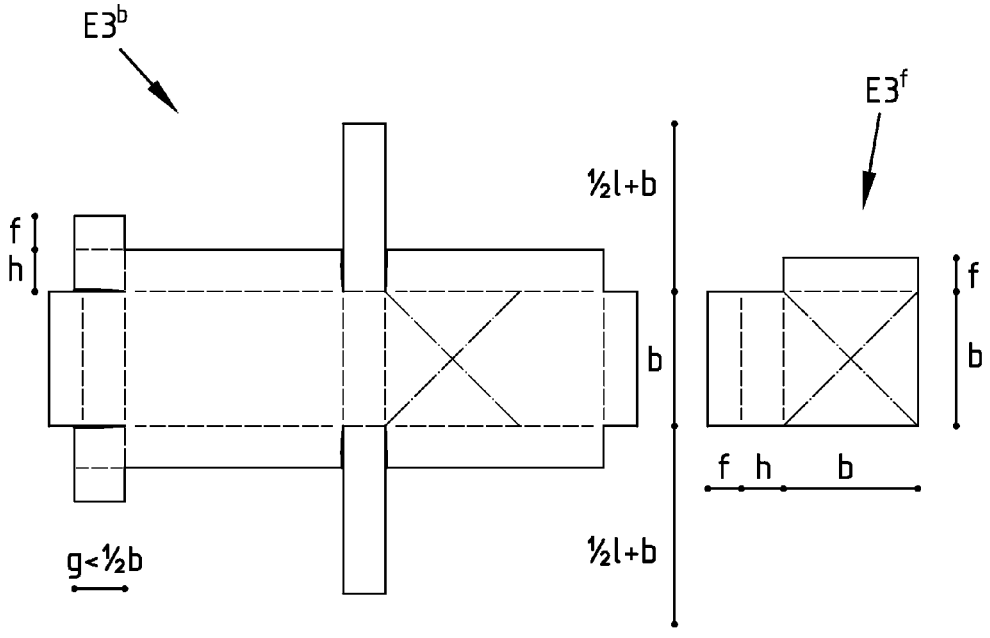
Figure 11A:
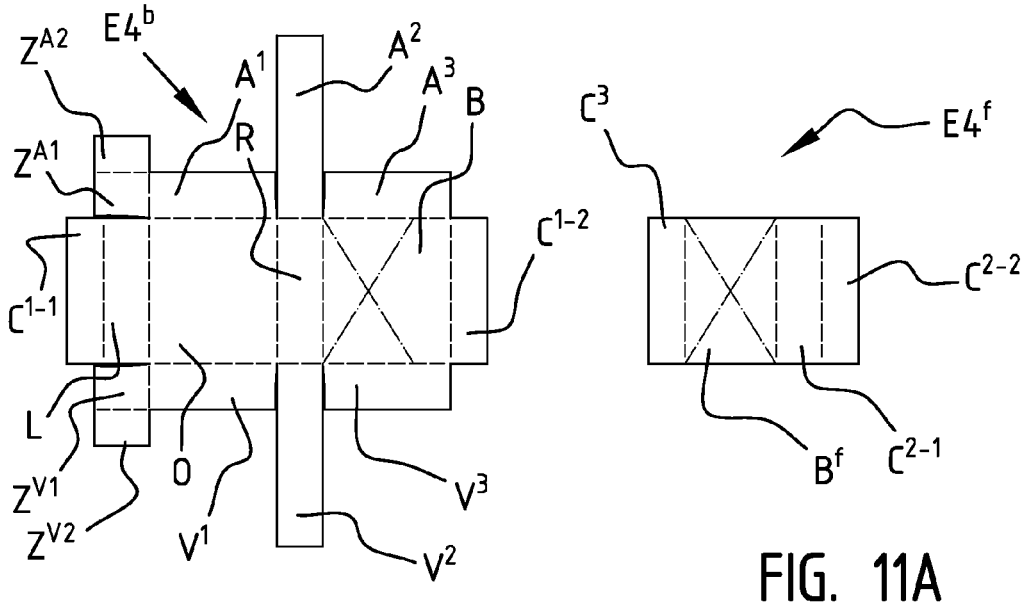
FIGS. 11A, 11B show a view of an unfolded second corner element (A) with dimensions of the surfaces (B)
Figure 11B:
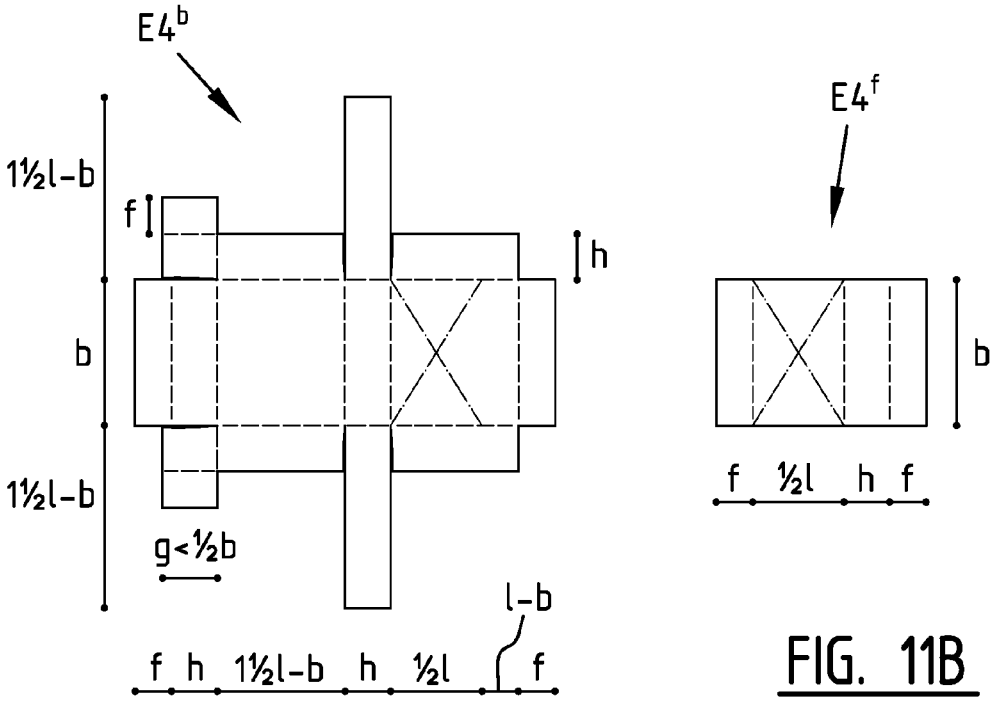
Figure 12A:
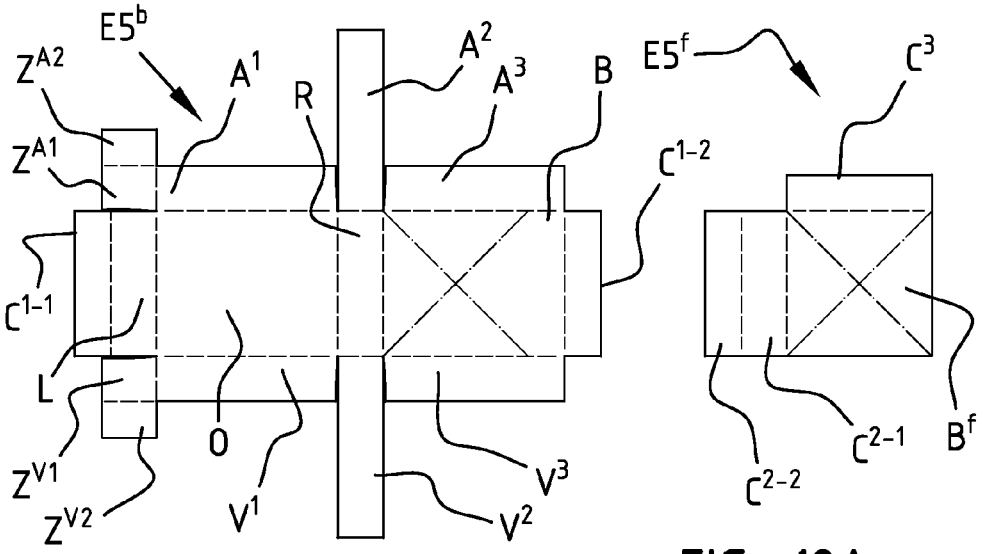
FIGS. 12A, 12B show a view of an unfolded third corner element (A) with dimensions of the surfaces (B)
Figure 12B:
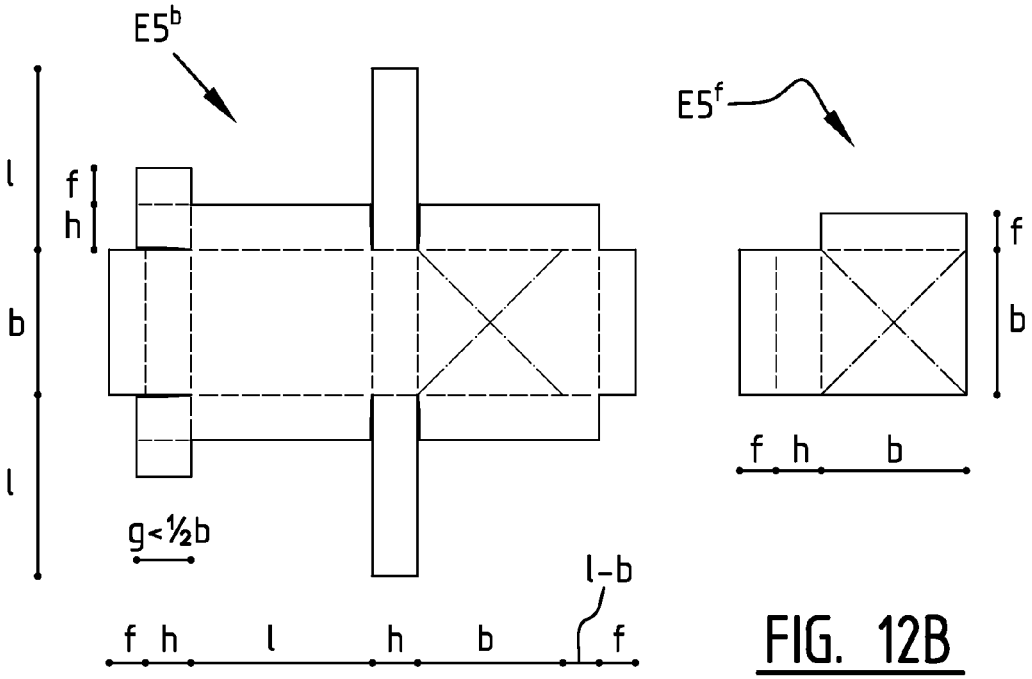
Figure 13A:
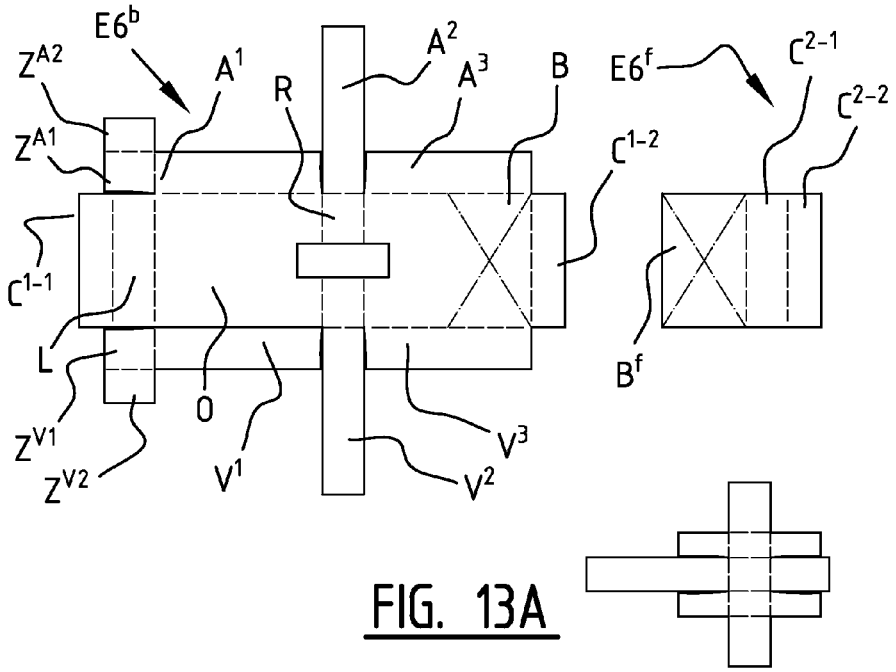
FIGS. 13A, 13B show a view of an unfolded basic adjusting frame element (A) with dimensions (B)
Figure 13B:
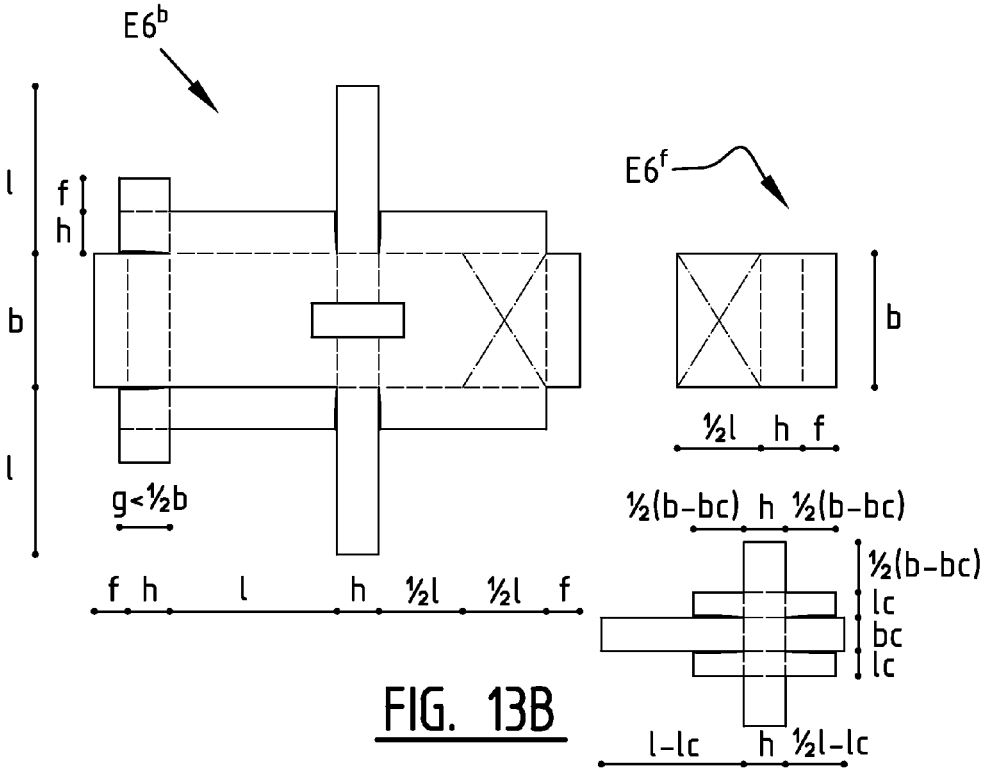
Figure 14A:
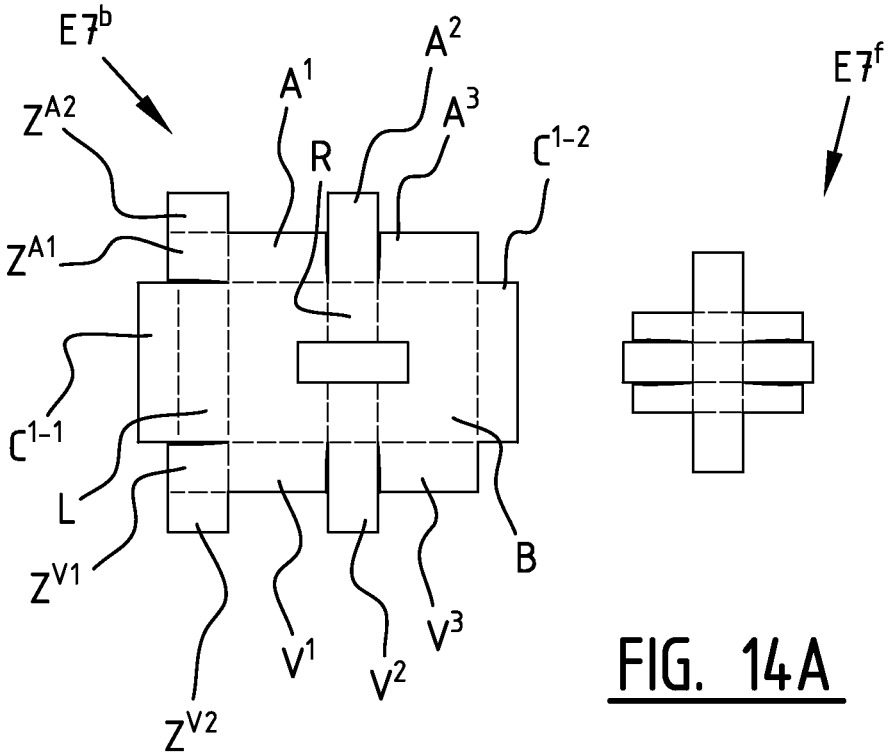
FIGS. 14A, 14B show a view of an unfolded filler adjusting frame element (A) with dimensions (B)
Figure 14B:
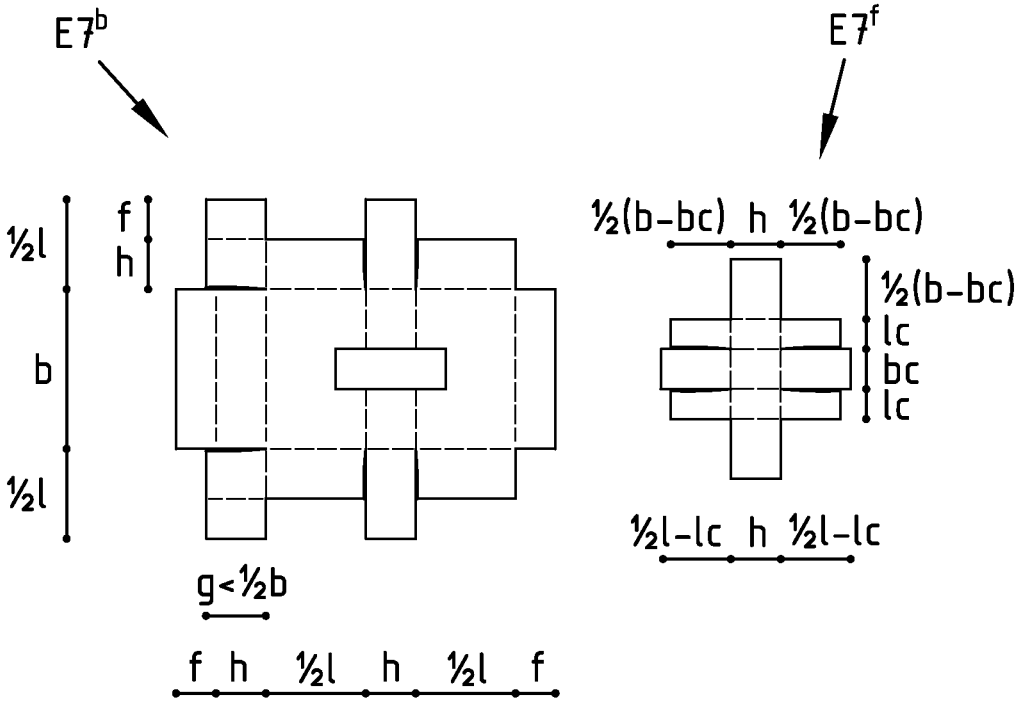

FIGS. 8A and 8B show views of an unfolded basic wall element E1, wherein FIG. 8A shows the different surfaces of the basic wall element E1 and wherein FIG. 8B shows the dimensions of the different surfaces. This basic wall element E1 of FIGS. 8A and 8B corresponds with the unfolded piece of geotextile shown in FIG. 1, and has already been discussed at length there.

The other construction elements, respectively filling wall element E2, first corner element E3, second corner element E4, third corner element E5, the basic adjusting frame element E6, the filler adjusting frame element E7, fourth corner element E8 and fifth corner element E9 are constructed and assembled in similar manner. It is particularly noted that the dimensions shown in FIGS. 9B-14B are correlated to the dimensions of the basic wall element E1 shown in FIG. 8B.

Figure 15A:
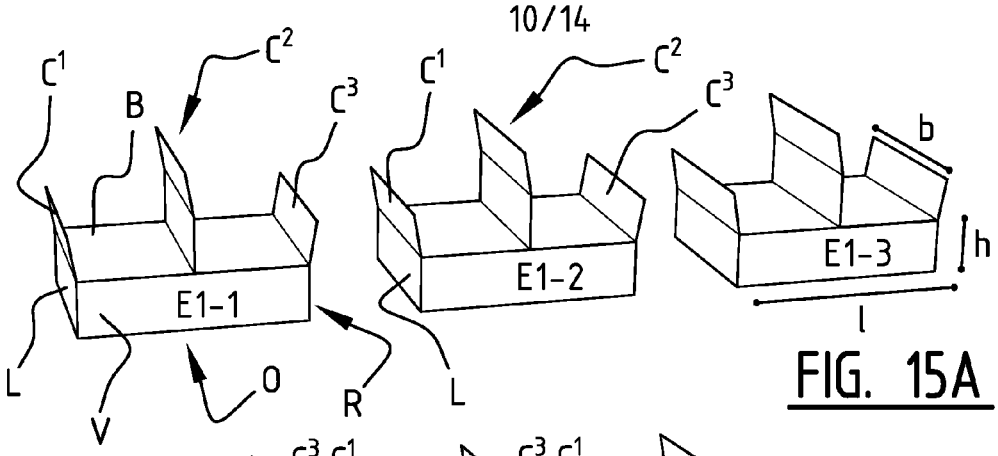
FIG. 15A is a perspective view of three basic wall elements.

With reference to FIGS. 15A-15D will now be elucidated how a wall of a building structure is erected using construction elements E1, E2 according to the invention. FIG. 15A shows three basic wall elements E1, respectively E1-1, E1-2 and E1-3. Each basic wall element E1 has a front surface V, a rear surface A, a left end surface L, a right end surface R, a lower surface O and an upper surface B.

Three connecting flaps $C^1$, $C^2$ and $C^3$ are arranged on upper surface B, wherein connecting flap $C^2$ is situated midway between end surfaces L and R and wherein connecting flap $C^2$ extends from upper surface B over a distance which is at least greater than the height h of basic wall element E1. In the shown embodiment the connecting flap $C^2$ extends over a distance substantially twice the height h of the basic wall element E1 from upper surface B.

When basic wall elements E1-1 and E1-2 are placed with their end surfaces R and L mutually abutting, connecting flaps $C^3$ and $C^1$ also come to lie against each other. Basic wall elements E1-1 and E1-2 are connected to each other by sewing connecting flaps $C^3$ and $C^1$ fixedly to each other, wherein at least one sewing seam is located close to upper surface B of basic wall elements E1. The sewn together connecting flaps $C^3$ and $C^1$ of the respective basic wall elements E1-1 and E1-2 are then folded flat onto one of the two elements as shown in FIG. 15B, in which a layer of three connected basic wall elements E1-1 and E1-2 is shown.

Figure 15B:
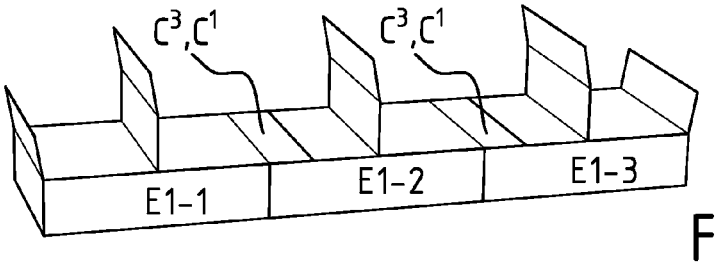
FIG. 15B is a perspective view of the step of coupling the three basic wall elements shown in FIG. 15A in a layer.
Figure 15C:
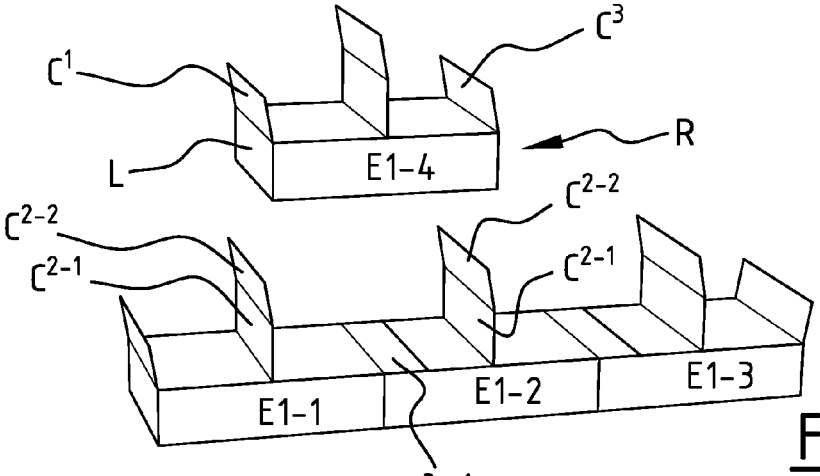
FIG. 15C is a perspective view of the basic wall elements coupled to each other in the step of FIG. 15B, and a further basic wall element to be placed thereabove.

FIG. 15C shows a basic wall element E1-4 which can be placed in half-brick bond on the layer formed in FIG. 15B between the second connecting flaps $C^2$ of respectively the basic wall element E1-1 and the basic wall element E1-2. Connecting flaps $C^2$ of the two adjacently placed basic wall elements E1-1, E1-2 fixed to each other extend respectively along the left end surface L and the right end surface R of the basic wall element E1-4 to be placed thereon in half-brick bond. The left end surface L of basic wall element E1-4 is placed against the first part $C^{2-1}$ of second connecting flap $C^2$ of the first basic wall element E1-1. The first connecting flap $C^1$ of the basic wall element E1-4 hereby comes to lie along the second part $C^{2-2}$ of the second connecting flap $C^2$ of basic wall element E1-1. By mutually connecting the second part $C^{2-2}$ of the second connecting flap $C^2$ of basic wall element E1-1 and the first connecting flap $C^1$ of basic wall element E1-4, the construction elements E1-1 and E1-4 in different height layers of the building structure are coupled to each other, this making possible a very sturdy building structure.

In similar manner the third connecting flap $C^3$ of the basic wall element E1-4 is connected to the second part $C^{2-2}$ of the second connecting flap $C^2$ of basic wall element E1-2.

Figure 15D:
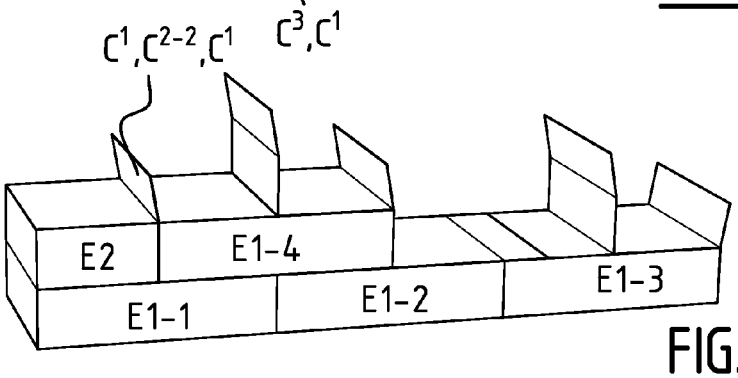
FIG. 15D is a perspective view of the step of coupling the basic wall elements shown in FIG. 15A to each other.

Using filling wall elements E2, which have a length which is half the length of a basic wall element E1, a wall can be filled on the end face such that the end face can be made flat while the half-brick bond is retained (FIG. 15D). These filling wall elements E2 have only one connecting flap $C^1$ which, in the situation shown in FIG. 15D, is connected to the second part $C^{2-2}$ of the second connecting flap $C^2$ of basic wall element E1-1 and the first connecting flap $C^1$ of basic wall element E1-4.

Figure 16:
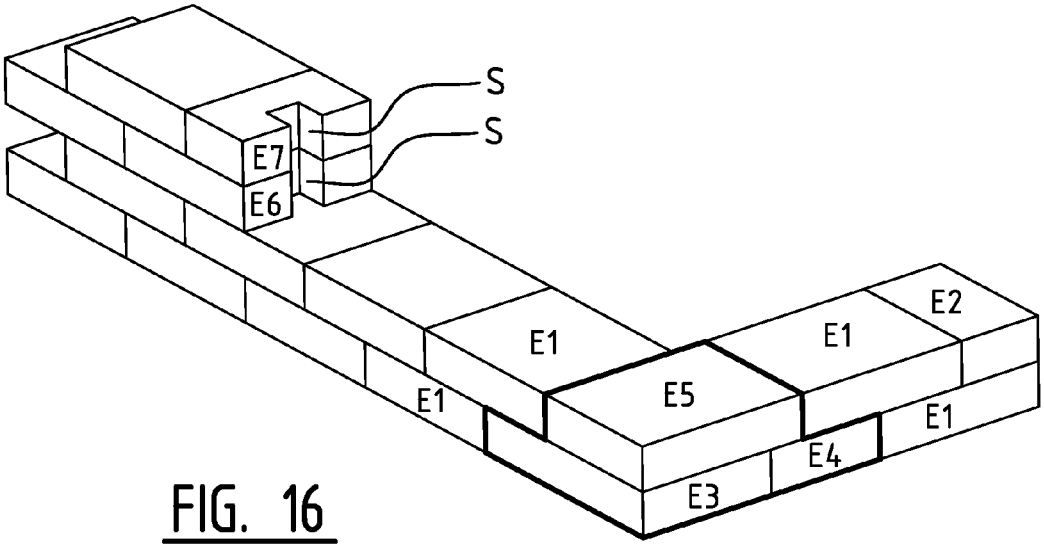
FIG. 16 is a perspective view of a building structure erected from construction elements with a corner according to a first aspect of the invention.

FIG. 16 shows a part of a building structure, wherein the basic adjusting frame element E6 and the filler adjusting frame element E7 have on at least one end surface thereof a channel-like recess S in height direction which is suitable for receiving therein an adjusting frame (not shown). The basic adjusting frame elements E6 have dimensions identical to those of basic wall elements E1. The filler adjusting frame elements E7 have dimensions identical to those of the filling wall elements E2.

The building structure shown in FIG. 16 also has a corner which, according to a first aspect of the invention, is assembled from three elements E3, E4, E5. How a corner part according to the first aspect of the invention is assembled is now further elucidated with reference to FIGS. 17A-17G.

Figure 17A:
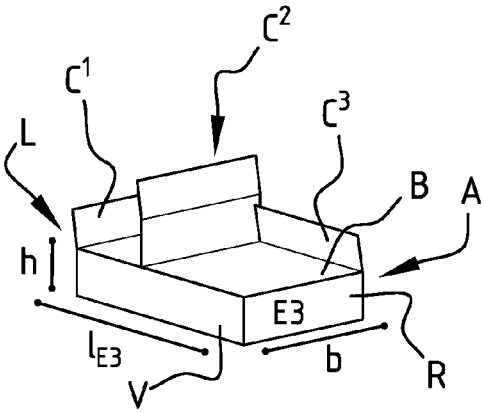
FIGS. 17A-17G show seven sub-steps in the assembly of the corner part shown in FIG. 16 from construction elements.

As shown in FIG. 17A, a first corner element E3 is placed in the corner. These first corner elements comprise the same width b and height h as basic wall elements E1, but the length $l_{E3}$ is substantially equal to the sum of the width b and half the length $l_{E1}$ of a basic wall element E1. A first connecting flap $C^1$ is arranged close to an end surface L and a connecting flap $C^3$ is arranged close to at least a part of a side of rear surface A of the first corner element E3. Further provided is a connecting flap $C^2$ which is arranged on upper surface B between the two end surfaces L, R and wherein the distance from the end surface L substantially corresponds to half the length of basic wall element E1, and the distance from end surface R substantially corresponds to the width b of a basic wall element E1. Connecting flap $C^2$ extends from upper surface B over a distance greater than the height h of basic wall element E1. In the shown embodiment the second connecting flap $C^2$ extends from upper surface B substantially over a distance of twice the height h of basic wall element E1.

Figure 17B:
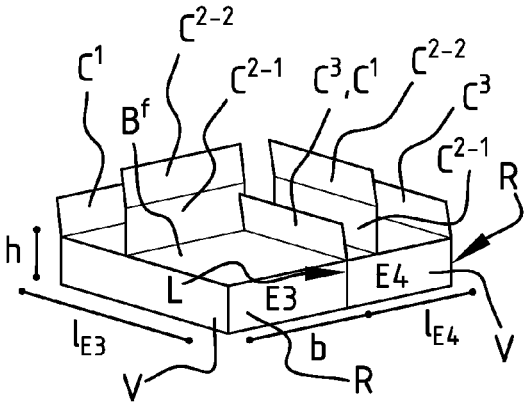

FIG. 17B shows how a second corner element E4, which has the same width b and height h as basic wall element E1, but the length $l_{E4}$ of which is substantially equal to one and a half times the length $l_{E1}$ of basic wall element E1 minus the width b of basic wall element E1, is arranged against the first corner element E3. Connecting flaps $C^1$, $C^3$ are provided close to both end surfaces L, R.

The second corner element E4 also has a connecting flap $C^2$ arranged on upper surface B between the two end surfaces L, R, and wherein the distance from end surface L substantially corresponds to a length $l_E$, of a basic wall element E1 minus the width b of a basic wall element E1. The distance of connecting flap $C^2$ from end surface R substantially corresponds to half the length $l_{E1}$ of a basic wall element E1.

Once the third corner element E4 has been placed with its left end surface L against rear surface A of the first corner element E3, the connecting flap $C^3$ of the first corner element E3 and the connecting flap $C^1$ of the second corner element E4 are mutually connected by sewing the two flaps $C^3$, $C^1$ to each other.

Figure 17C:
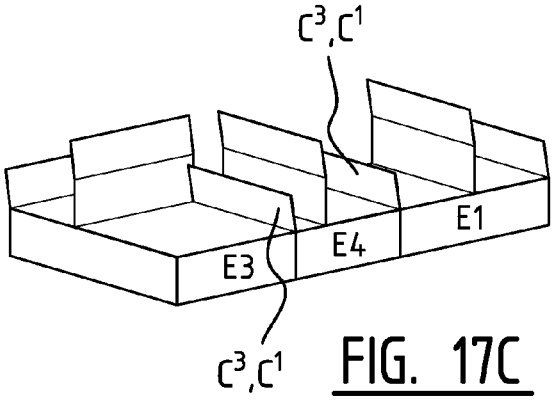

As shown in FIG. 17C, a basic wall element E1 is placed in the manner already described above on the right end surface R of the second corner element E4.

Figure 17D:
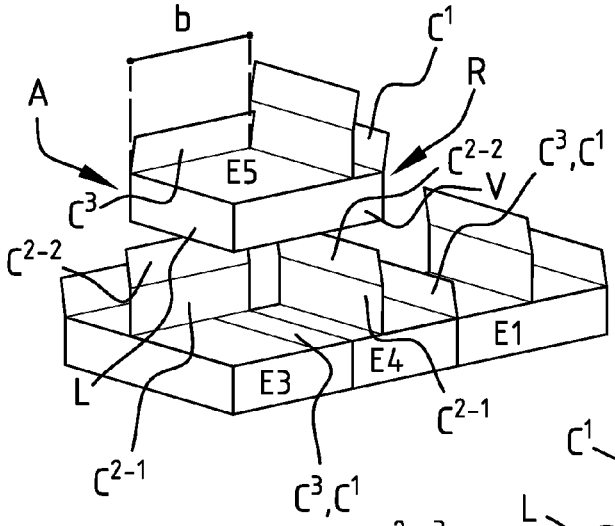
Figure 17E:
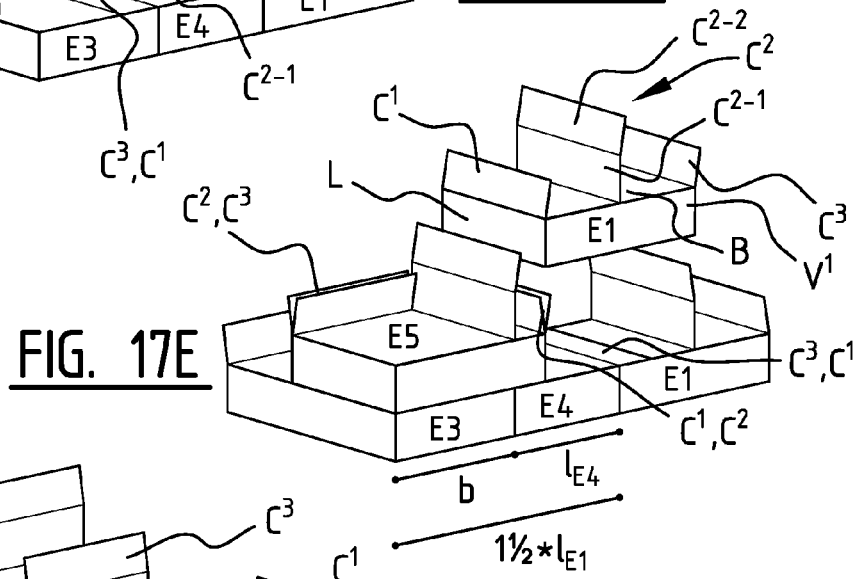

Placed on top of first corner element E3 and second corner element E4 as shown in FIG. 17D is a third corner element E5 having the same width b, height h and length 1 as basic wall elements E1. A connecting flap $C^1$ is arranged close to an end surface of the third corner element E5 and a connecting flap $C^3$ is arranged at least close to a part of a side of rear surface A of the third corner element E5.

The third corner element E5 is further provided with a further connecting flap $C^2$ which is arranged on upper surface B between the two end surfaces L, R and wherein the distance from the end surface L substantially corresponds to a width b of a basic wall element E1 and the distance from the other end surface R substantially corresponds to a length 1 of a basic wall element E1 minus a width of a basic wall element E1.

Connecting flap $C^2$ extends from upper surface B at least over a distance greater than the height h. In the embodiment shown in FIG. 17D the connecting flap $C^2$ extends over a distance of roughly twice the height of a basic wall element E1.

Once the third corner element E5 has been placed on top of the first corner element E3 and the second corner element E4 (FIG. 17E), a further basic wall element E1 is placed adjacently of this third corner element E5. Connecting flaps $C^1$ of the third corner element E5, $C^2$ of the second corner element E4 and $C^1$ of the basic wall element E1 are then sewn to each other.

Figure 17F:
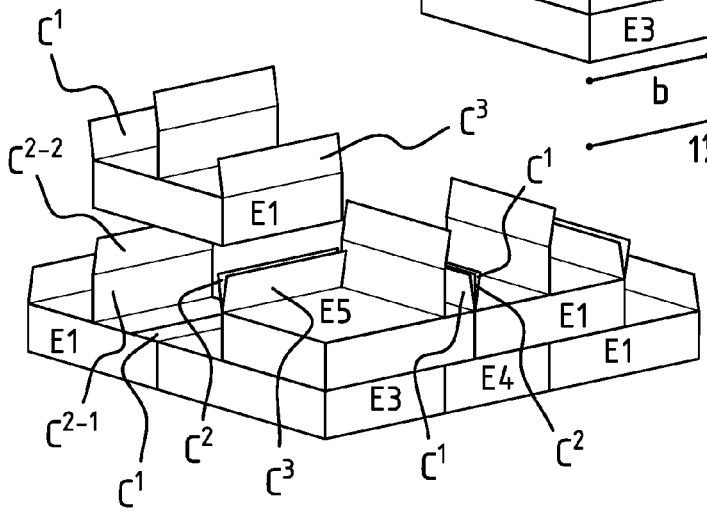
Figure 17G:
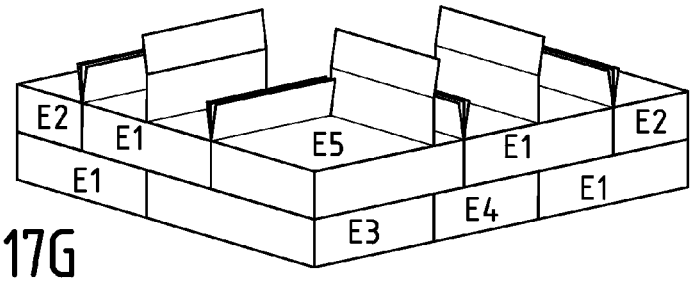

FIGS. 17F and 17G show how further basic wall elements E1 and filling wall elements E2 are arranged in order to complete the building structure.

Figure 18:
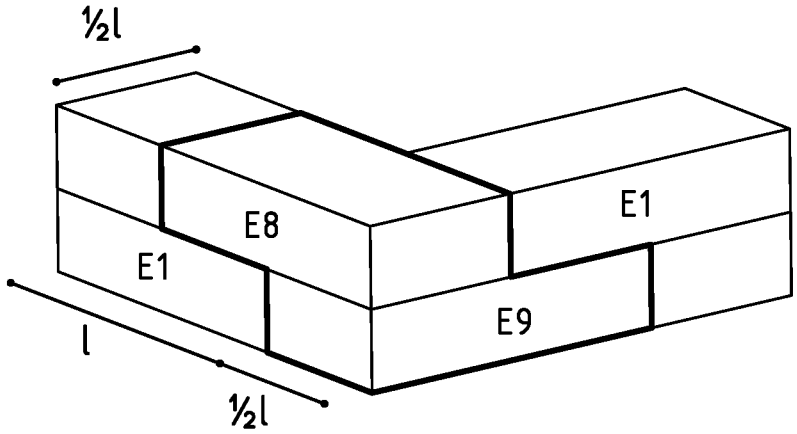
FIG. 18 is a perspective view of a building structure erected from construction elements with a corner according to a second aspect of the invention.

FIG. 18 is a perspective view of a building structure erected from construction elements with a corner according to a second aspect of the invention. According to this second aspect, the basic wall element E1, the basic adjusting frame element E6, and two corner elements, respectively fourth corner element E8 and fifth corner element E9, have a length/width ratio of L:B=2:1.

Figure 19:
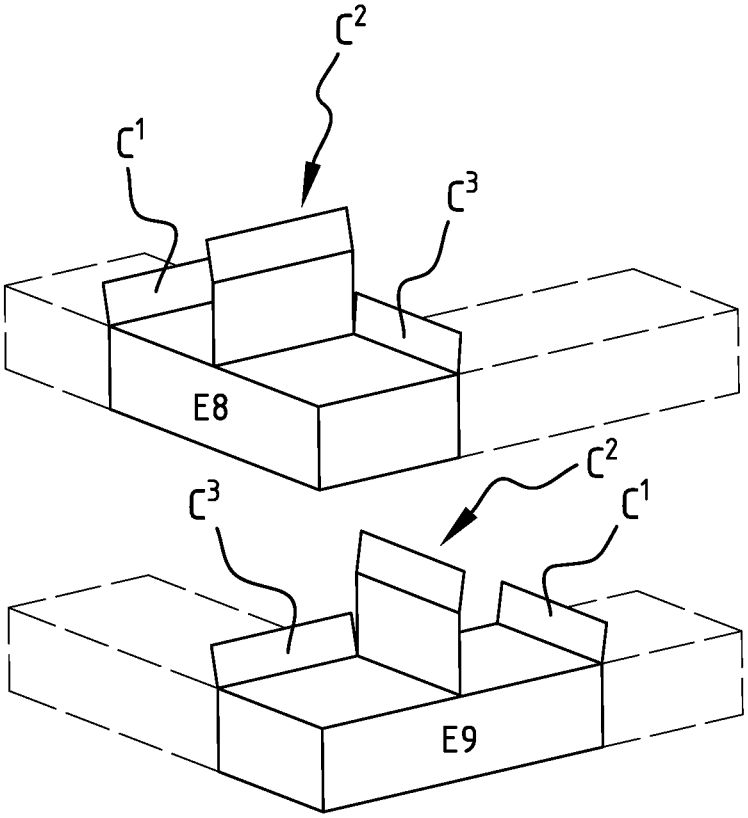
FIG. 19 shows two corner elements for assembling the corner part of FIG. 18 according to the second aspect of the invention.

Because the construction elements have a length/width ratio of 2:1, they provide the particular advantage that only two different corner elements, respectively fourth corner element E8 and fifth corner element E9 shown in FIG. 19, are necessary to arrange a corner in a building structure.

The fourth and fifth corner elements E8, E9 have the same width b, height h and length l as a basic wall element E1. A connecting flap $C^1$ is arranged close to an end surface of the corner element and a connecting flap $C^3$ is arranged at least close to a part of a side of a front or rear flap V, A of corner element E8, E9.

Further arranged on the upper surface of corner elements E8 and E9 is a further connecting flap $C^2$ situated substantially midway between the two end surfaces L, R. In the embodiment shown in FIG. 19 the connecting flap $C^2$ extends from upper surface B over a distance of about twice the height h of a basic wall element E1.

It is noted that the fourth corner element E8 and fifth corner element E9 have dimensions equal to those of basic wall element E1, this further simplifying the system of construction elements according to the invention. The only difference between fourth corner elements E8 and fifth corner elements E9 is the structure of connecting flaps $C^2$ and $C^3$, which take a mirrored form between the two corner elements.

Corner elements E8 and E9 are very simple to make as only the flap part of the construction element has to take a mirrored form.

Figure 20:
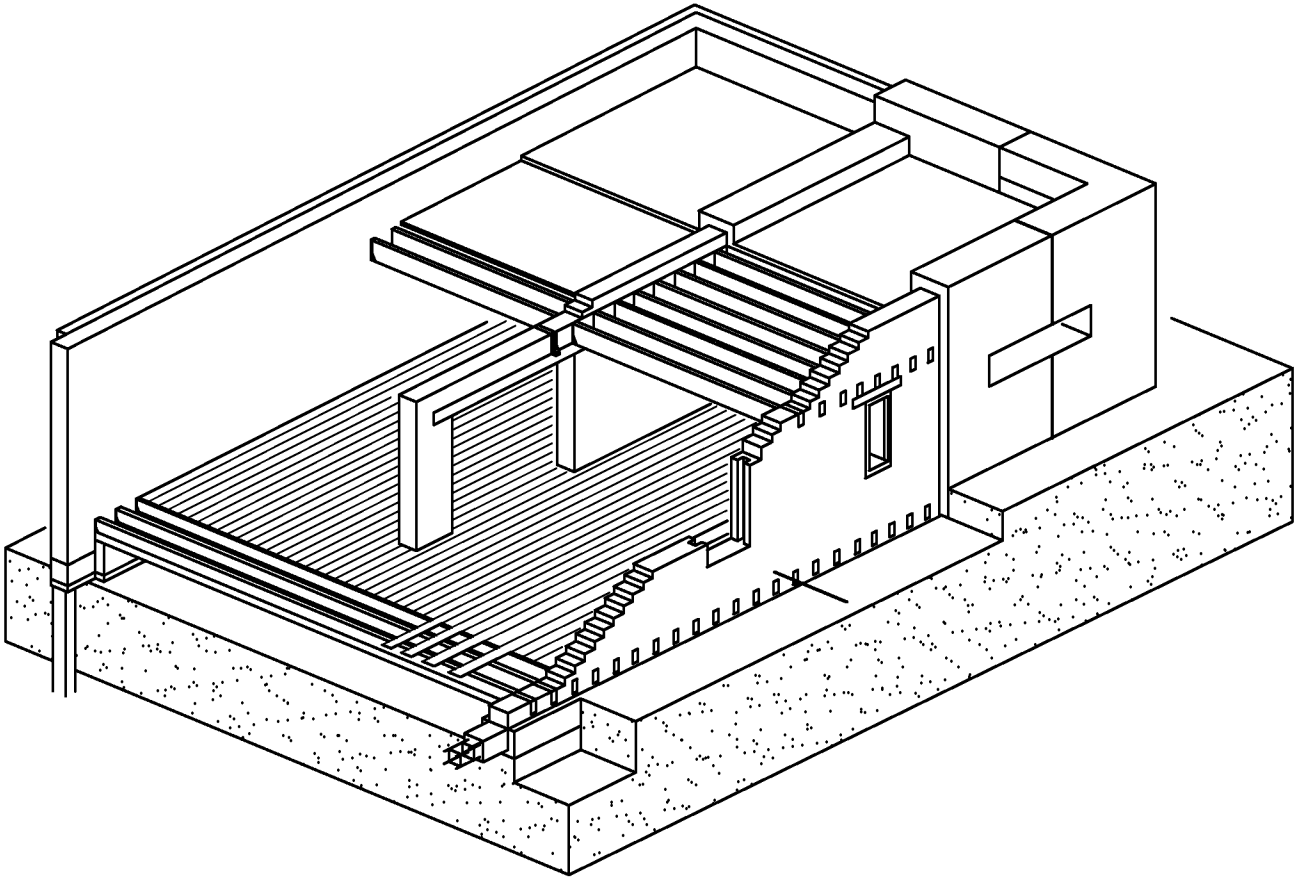
FIG. 20 shows a building erected from construction elements according to the invention.

FIG. 20 is a perspective view of a building erected from construction elements according to the present invention.

Although they show preferred embodiments of the invention, the above described embodiments are intended solely for the purpose of illustrating the present invention and not to limit the scope of the invention in any way. It is particularly noted that the skilled person can combine technical measures of the different embodiments, such as the use of the filling elements described in respect of the first aspect in the embodiment according to the second aspect of the invention. The scope of the invention is therefore defined solely by the following claims.

We claim:

1. A method for erecting a building structure with construction elements, comprising the steps of:

providing a first bag which comprises an upper side, a lower side, a front side, a rear side, a right end and a left end and which is fillable to substantially a block shape using filling material; the first bag having a first connecting flap extending from the right end and a second connecting flap extending from the left end;

providing a second bag which comprises an upper side, a lower side, a front side, a rear side, a right end and a left end and which is fillable to substantially a block shape using filling material, the second bag having a first connecting flap extending from the right end and a second connecting flap extending from the left end;

providing a third bag which comprises an upper side, a lower side, a front side, a rear side, a right end and a left end and which is fillable to substantially a block shape using filling material, the third bag having a first connecting flap extending from the right end and a second connecting flap extending from the left end;

providing a fourth bag which comprises an upper side a lower side, a front side, a rear side, a right end and a left end and which is fillable to substantially a block shape using filling material, the fourth bag having a first connecting flap extending from the right end;

filling the first second, third and fourth bags with filling material to substantially a block shape;

attaching the first connecting flap of the first bag to the second connecting flap of the second bag;

attaching the second connecting flap of the first bag to the first connecting flap of the third bag;

wherein a third connecting flap is further arranged on the upper side of the first bag between the left and right ends, and the third connecting flap of the first bag extends at least over a distance greater than the height of the fourth bag;

positioning the fourth bag over the left upper side of the second bag; and attaching the third connecting flap of the first bag to the first connecting flap of the fourth bag.

2. The method of claim 1, wherein the connecting flaps are connected to each other by being sewn together.

3. The method of claim 1, wherein the connecting flaps are connected to each other by gluing.

4. The method of claim 1, further comprising the steps of:

providing a fifth bag which comprises an upper side, a lower side, a front side, a rear side, a right end and a left end and which is tillable to substantially a block shape using filling material, the fifth bag having a first connecting flap extending from the left end;

filling the fifth bag with fillable material;

positioning the fifth bag over the right upper side of the first bag;

attaching the first connecting flap of the fifth bag to the third connecting flap of the first bag and to the first connecting flap of the fourth bag.

5. A system of construction elements, comprising:

a first bag which comprises an upper side, a lower side, a front side, a rear side, a right end and a left end and which is fillable to substantially a block shape using filling material the first bag having a first connecting flap extending from the right end and a second connecting flap extending from the left end;

a second bag which comprises an upper side, a lower side, a front side, a rear side, a right end and a left end and which is fillable to substantially a block shape using filling material, the second bag having a first connecting flap extending from the right end and a second connecting flap extending from the left end;

a third bag which comprises an upper side, a lower side, a front side, a rear side, a right end and a left end and which is fillable to substantially a block shape using filling material, the third bag having a first connecting flap extending from the right end and a second connecting flap extending from the left end;

wherein the first connecting flap of the first bag is attachable to the second connecting flap of the second bag;

wherein the second connecting flap of the first bag is attachable to the first connecting flap of the third bag;

wherein a third connecting flap is further arranged on the upper side of the second bag between the left and right ends, and further including a fourth bag which comprises an upper side, a lower side, a front side, a rear side, a right end and a left end and which is fillable to substantially a block shape using filling material, the fourth bag having a first connecting flap extending from the right end;

wherein the third connecting flap of the second bag extends at least over a distance greater than the height of a basic wall element; and wherein when the fourth bag is positioned over the left upper side of the second bag, the third connecting flap of the second bag is attachable to the first connecting flap of the fourth bag;

wherein a third connecting flap is further arranged on the upper side of the second bag between the left and right ends, and further including a fourth bag which comprises an upper side, a lower side, a front side, a rear side, a right end and a left end and which is fillable to substantially a block shape using filling material, the fourth bag having a first connecting flap extending from the right end;

wherein the third connecting flap of the second bag extends at least over a distance greater than the height of a basic wall element; and wherein when the fourth bag is positioned over the left upper side of the second bag, the third connecting flap of the second bag is attachable to the first connecting flap of the fourth bag.

6. The system of claim 5, wherein the first, second, and third bags are manufactured from textile, wherein the textile includes geotextile.

7. The system of claim 5, wherein the first, second, and third bags are reinforced with carbon fiber.

8. The system of claim 5, wherein the first, second, and third bags are of a first type where the upper side, lower side, front side, rear side, right end and left end each have a length, a width and a height.

9. The system of claim 5, wherein the third connecting flap of the first bag is arranged on the upper side of the first bag and substantially midway between the right and left end.

10. The system of claim 5, further comprising:

a fifth bag which comprises an upper side, a lower side, a front side, a rear side, a right end and a left end and which is fillable to substantially a block shape using filling material, the fifth bag having a first connecting flap extending from the front side;

wherein the fifth bag is of a second type where the upper side, lower side, front side, rear side, right end and left end have a length, a width and a height, wherein the length of the fifth bag has substantially half the length of the first bag; and wherein a third connecting flap extending from the rear side of the third bag is attachable to the first connecting flap of the fifth bag.

11. The system of claim 10, wherein the third bag has a length that is substantially equal to the sum of the width of the fourth bag and half the length of the first bag; and wherein the third and fifth bags provide a first corner element when the third connecting flap of the third bag is attached to the first flap of the fifth bag.

12. The system of claim 5, further comprising:

a fifth bag which comprises an upper side, a lower side, a front side, a rear side, a right end and a left end and which is fillable to substantially a block shape using filling material, the fifth bag having a first connecting flap extending from the front side;

wherein the fifth bag is of a second type where the upper side, lower side, front side, rear side, right end and left end have a length, a width and a height, wherein a third connecting flap extending from the rear side of the second bag is attachable to the first connecting flap of the fifth bag.

13. The system of claim 12, further comprising:

wherein the third bag has a length that is substantially equal to the sum of the width of the fifth bag and half the length of the first bag; and wherein the third and fifth bags provide a second corner element when the third connecting flap of the second bag is attached to the first flap of the fifth bag.

14. The system of claim 5, wherein the first, second, and third bags include a length-width ratio of 2:1.

15. The system of claim 5, further comprising:

a fifth bag which comprises an upper side, a lower side, a front side, a rear side, a right end, and a left end which is fillable to substantially a block shape using filling material, the fifth bag having a first connecting flap extending from the front side;

wherein a third connecting flap of the first bag extending from a rear side of the first bag is attachable to the first connecting flap of the fifth bag.

16. The system of claim 5, wherein first and second connecting flaps of the first, second, and third bags, are integrally formed with the first, second, and third bags respectively.

17. The system of claim 5, wherein the first connecting flap of the first bag extends from an intersection of the upper side and right end of the first bag and the second connecting flap of the first bag extends from an intersection of the upper side and left end of the first bag.

18. The system of claim 5, further including a fifth bag which comprises an upper side, a lower side, a front side, a rear side, a right end and a left end and which is fillable to substantially a block shape using filling material, the fifth bag having a first connecting flap extending from the left end;

wherein when the fifth bag is positioned over the right upper side of the first bag, the third connecting flap of the first bag is attachable to the first connecting flap of the fifth bag; and wherein the first connecting flap of the fifth bag is also attachable to the first flap of the fourth bag.

* * * * *